US007837802B2

(12) United States Patent
Kang

(10) Patent No.: US 7,837,802 B2
(45) Date of Patent: Nov. 23, 2010

(54) DISHWASHER AND METHOD OF CONTROLLING THE SAME

(75) Inventor: Hong Ki Kang, Busan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/353,137

(22) Filed: Jan. 13, 2009

(65) Prior Publication Data

US 2009/0217948 A1 Sep. 3, 2009

Related U.S. Application Data

(62) Division of application No. 11/790,438, filed on Apr. 25, 2007, now abandoned.

(30) Foreign Application Priority Data

Apr. 25, 2006 (KR) ..... 10-2006-0037014

(51) Int. Cl.
*B08B 7/04* (2006.01)
*B08B 3/10* (2006.01)

(52) U.S. Cl. ..... 134/18; 134/25.2; 134/56 D

(58) Field of Classification Search ..... 134/18, 134/19, 25.2

See application file for complete search history.

(56) References Cited

U.S. PATENT DOCUMENTS

| | | | | |
|---|---|---|---|---|
| 6,432,216 | B1 | 8/2002 | Thies | |
| 2003/0106570 | A1 | 6/2003 | Cerruti | |
| 2004/0088796 | A1 | 5/2004 | Neergaard et al. | |
| 2007/0246069 | A1 * | 10/2007 | Elick et al. | 134/18 |

FOREIGN PATENT DOCUMENTS

| | | | |
|---|---|---|---|
| DE | 10114256 | A1 | 10/2002 |
| EP | 0602572 | | 6/1994 |
| WO | WO 2006007234 | A2 * | 1/2006 |

* cited by examiner

*Primary Examiner*—Michael Kornakov
*Assistant Examiner*—Natasha Campbell
(74) *Attorney, Agent, or Firm*—Birch, Stewart, Kolasch & Birch, LLP

(57) ABSTRACT

There is provided a dishwasher and a method of controlling the dishwasher. The dishwasher includes a temperature detecting unit for detecting a temperature of washing water supplied, a rinse dispensing unit for dispensing rinse when washing water is heated up to a rinse dispensing temperature, and a control unit for varying the rinse dispensing temperature in accordance with the temperature of the washing water supplied.

3 Claims, 5 Drawing Sheets

DISHWASHER AND METHOD OF CONTROLLING THE SAME

This application is a Divisional of application Ser. No. 11/790,438 filed on Apr. 25, 2007, now abandoned and for which priority is claimed under 35 U.S.C. §120; and this application claims priority of Application No 10-2006-0037014 filed in Korea on Apr. 25, 2006 under 35 U.S.C. §119; the entire contents of all are hereby incorporated by reference.

BACKGROUND OF THE INVENTION

1. Field of the Invention

The present invention relates to a dishwasher. More particularly, the present invention relates to a dishwasher that can stably dispense rinse during a rinsing process and to a method of controlling the dishwasher.

2. Description of the Related Art

Generally, a dishwasher is a home appliance that washes and dries dishes by spraying washing water to surfaces of the dishes received therein.

The dishwasher performs a washing cycle, a rinsing cycle, and a drying cycle. In the washing cycle, washing water is mixed with detergent to effectively remove food residues adhered to the dishes. In the rinsing cycle, the washing water is mixed with rinse to effectively rinse the dishes. In the drying cycle, moisture adhered to the dishes are removed.

A heating time of a heater is preset in the dishwasher to perform the rinsing cycle. Therefore, in the rinsing cycle, when the washing temperature is heated to a preset rinse supply temperature, the rinse is supplied.

However, in the dishwasher of the related art, when the temperature of the washing water supplied is low, it takes long time for the washing water to reach the rinse supply temperature and thus the dishes are not effectively rinsed. In this case, the rinsing cycle is finished in a state where the rinse is adhered to surfaces of the dishes.

When the washing water is too cool, the washing water may not reach the rinse supply temperature. In this case, the rinsing cycle is performed without being supplied with the rinse. Therefore, the dishes are not sufficiently rinsed.

SUMMARY OF THE INVENTION

Accordingly, the present invention is directed to a dishwasher and a method of controlling the same that substantially obviates one or more problems due to limitations and disadvantages of the related art.

An object of the present invention is to provide a dishwasher that can stably supply rinse to sufficiently rinse dishes.

Another object of the present invention is to provide a method of controlling the dishwasher.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher including; a temperature detecting unit for detecting a temperature of washing water supplied; a rinse dispensing unit for dispensing rinse when washing water is heated up to a rinse dispensing temperature: and a control unit for varying the rinse dispensing temperature in accordance with the temperature of the washing water supplied.

In another aspect of the present invention, there is provided a dishwasher including: a sump for storing washing water supplied; a temperature detecting unit for detecting a temperature of the washing water supplied: a heating unit for heating the washing water stored in the sump: a detergent dispensing unit for storing detergent; a rinse dispensing unit for dispensing rinse to the sump when the washing water is heated up to a rinse dispensing temperature; and a control unit for varying the rinse dispensing temperature in accordance with the temperature of the washing water supplied.

In still another aspect of the present invention, there is provided a method of controlling a dishwasher, including: measuring a temperature of washing water supplied; heating the washing water; varying a rinse dispensing temperature in accordance with the temperature of the washing water supplied; and dispensing rinse to the washing water when the temperature of the washing water reaches a rinse dispensing temperature.

It is to be understood that both the foregoing general description and the following detailed description of the present invention are exemplary and explanatory and are intended to provide-further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

The following will describe a dishwasher according to an embodiment of the present invention.

Figure 1:
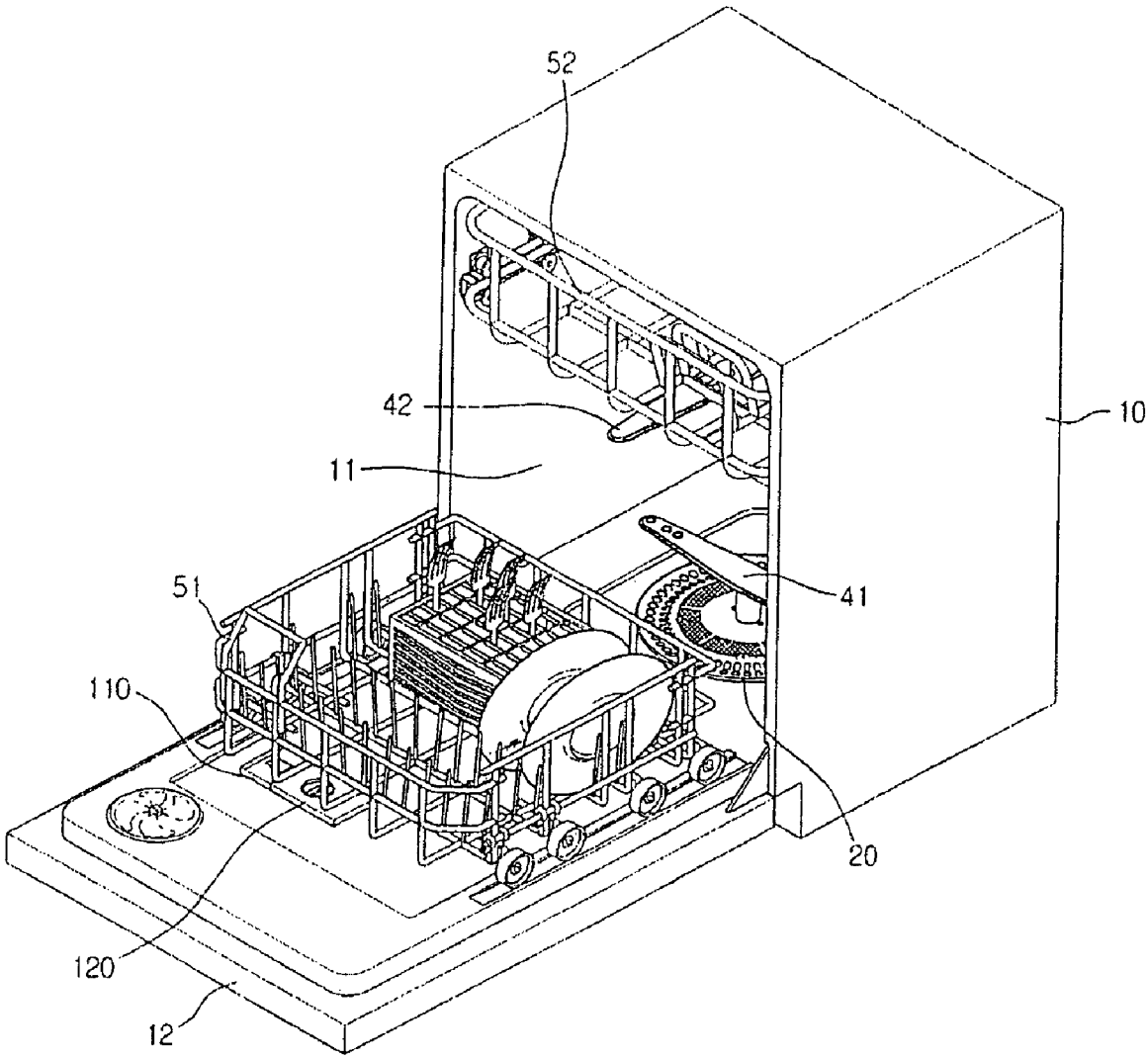
FIG. 1 is a perspective view of a dishwasher according to an embodiment of the present invention.

FIG. 1 is a perspective view of a dishwasher according to an embodiment of the present invention.

Referring to FIG. 1, a dishwasher includes a cabinet 10 defining an outer appearance thereof. A tub 11 defining a washing chamber is disposed in the cabinet 10. A door 12 is pivotally installed on a front portion of the cabinet 10.

A sump 20 for storing washing water is disposed under the tub 11. A washing pump 21 (see FIG. 2) for pumping out the washing water and a drain pump 22 (see FIG. 2) for draining the washing water are disposed in the sump 20.

A water guide (not shown) is connected to the tub 11 to guide the washing water pumped by the washing pump 21.

A plurality of spraying nozzles are connected to the water guide 31. The spraying nozzles may include a lower nozzle 41 and an upper nozzle 43.

Dish racks are disposed in the tub 11. The dish racks may include a lower rack 51 disposed at a lower portion of the tub 11 and an upper rack 52 provided on an upper portion of the tub 11. The lower and upper racks 51 and 52 are installed to be capable of being taken out of the tub 11. FIG. 1 shows a state where the lower rack 51 is taken out of the tub 11.

Detergent dispensing unit 110 and a rinse dispensing unit 120 may be disposed on the door 12. The respective detergent and rinse dispensing units 110 and 120 have surfaces that are exposed to an internal space of the tub 11. The detergent dispensing unit 110 stores detergent and the rinse dispensing unit 120 stores rinse.

Alternatively, the detergent dispensing unit 110 and the rinse dispensing unit 120 may be disposed in the tub 11 as far as they can dispense the detergent and rinse into the tub 11.

Figure 2:
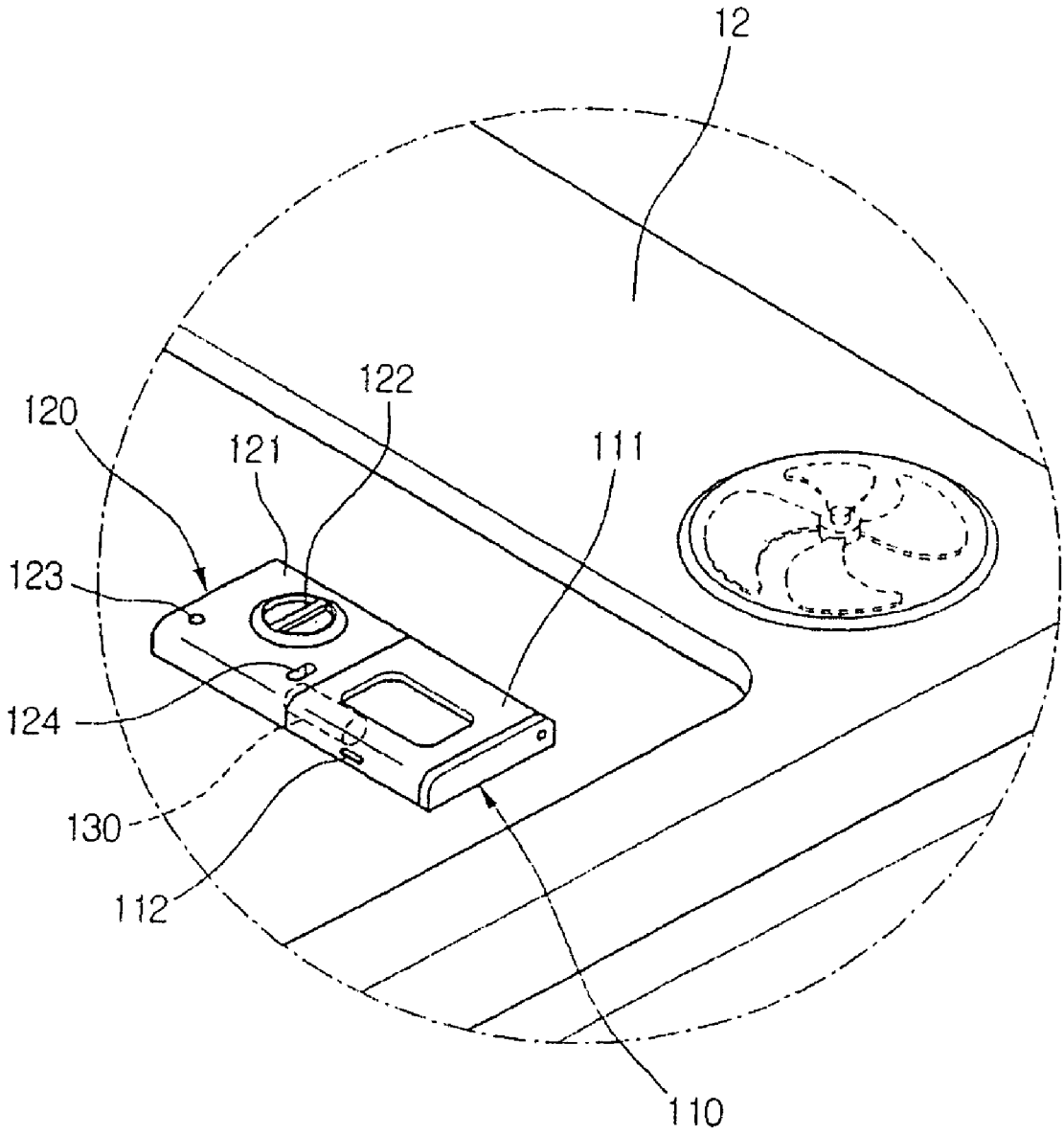
FIG. 2 is a perspective view of a detergent dispersing unit and a rinse dispensing unit of the dishwasher of FIG. 1.

FIG. 2 is a perspective view of the detergent dispersing unit and the rinse dispensing unit of the dishwasher.

Referring to FIG. 2, the detergent dispensing unit 110 may be sealed by a cover 111 that can be opened so that the detergent can be filled in the detergent dispensing unit 110.

The detergent dispensing unit 110 is provided at a side with a detergent dispensing hole 112 through which the detergent can be dispensed into the tub 11.

The rinse dispensing unit 120 includes a ease 121 in which the rinse is stored. A cap 122 is disposed on a front portion of the case 121. The cap 122 may be opened when filling the rinse therein. A rinse display window 123 may be provided on the case 121 of the rinse dispensing unit 120. Through the rinse display window 123, the user can identify a current amount of the rinse stored in the rinse dispensing unit 120. The case 121 is provided with a rinse dispensing hole 124 through which the rinse can be dispensed into the tub 11.

The detergent dispensing unit 110 and the rinse dispensing unit 120 may be disposed adjacent to each other. In this case, a valve 130 is disposed between the detergent and rinse dispensing units 110 and 120. The valve 130 selectively opens the detergent dispensing hole 112 and the rinse dispensing hole 124. The opening and closing of the detergent and rinse dispensing units 112 and 120 are controlled by the single valve 130, thereby reducing the manufacturing costs.

Figure 3:
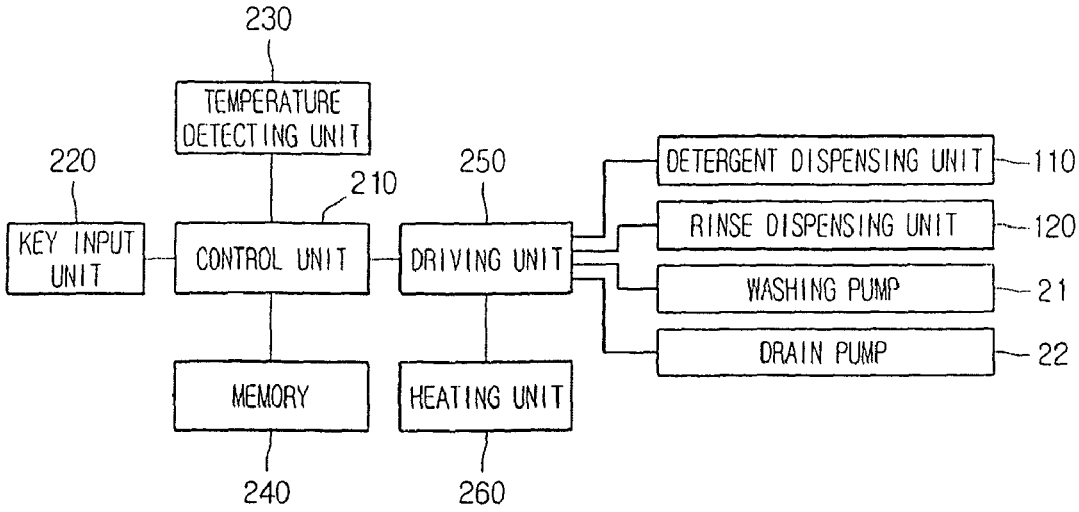
FIG. 3 is a block diagram of the dishwasher of FIG. 1.

FIG. 3 is a block diagram of the dishwasher.

Referring to FIG. 3, the dishwasher includes a control system for controlling the operation of the dishwasher.

The control system 100 includes a control unit 210 and a key input unit 210 for inputting a washing condition including a washing course. A temperature detecting unit 230 for detecting a temperature of the water supplied is connected to the control unit 210.

A memory unit 240 for storing data transferred from the key input unit 220 and the temperature detecting unit 230 is connected to the control unit 210. A hot water washing process, a rinsing temperature, a rinse dispensing temperature, and the like are preset in the memory unit 240.

The temperature detecting unit 230 may be disposed on a fluid passage through which the washing water is supplied. The key input unit 220, the control unit 210, and the memory unit 240 may be disposed on the control panel 13 provided on a front portion of the door 21 (see FIG. 1).

Electrically connected to the control unit 210 is a driving unit 250. A heating unit 260 for heating the washing water is electrically connected to the driving unit 250. The heating unit 260 may be disposed in the sump 20 (see FIG. 1).

Electrically connected to the driving unit 250 are the washing pump 21, the drain pump 22, and the heating unit 260. The detergent and rinse dispensing units 110 and 120 are further electrically connected to the driving unit 250.

The control unit 210 controls the driving unit 250 in response to information transferred from the key input unit 220 and the temperature detecting unit 230. The driving unit 250 operates the washing pump 21, the drain pump 22, the detergent dispensing unit 110, the rinse dispensing unit 120, and the heating unit 260 in accordance with the control of the control unit 210. At this point, the driving unit 250 controls the detergent and rinse dispensing units 110 and 120 by controlling the valve 130.

The following will describe an overall washing process of the above-described dishwasher of the embodiment of the present invention.

Figure 4:
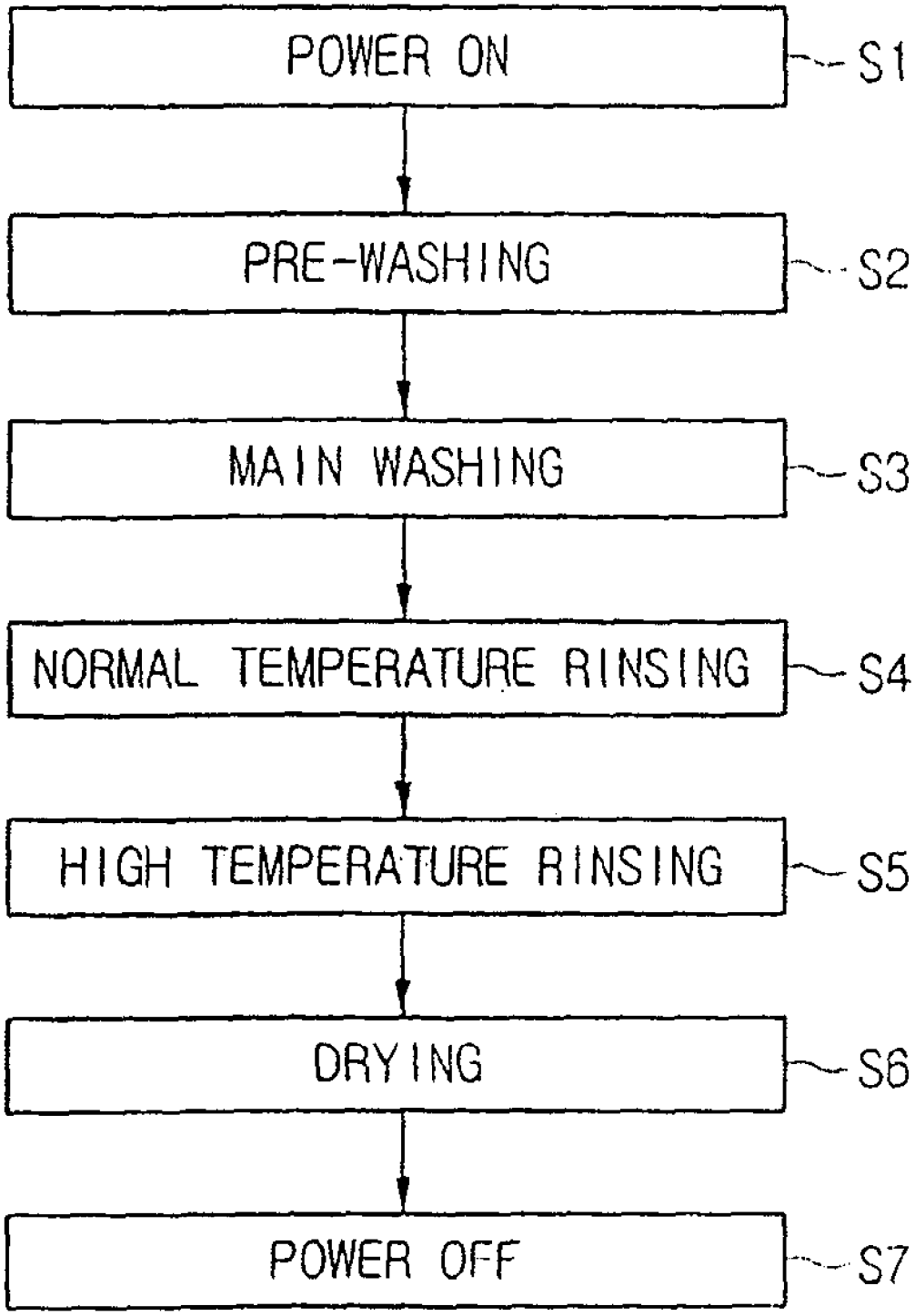
FIG. 4 is a flowchart illustrating an overall washing process of the dishwasher of FIG. 1.

Referring to FIG. 4, after the power of the dishwasher is turned on (S1), a washing condition is input through the key input unit 110. Further, when an operating button of the control panel 13 is pushed, a pre-washing process is performed (S2).

At this point, the washing water is fed into the sump 20. The washing water may be cool water or warm water. The temperature of the washing water may be changed according to the seasons.

When the water is filled in the sump 21 up to a predetermined water level, the supply of the water to the sump 21 is stopped. As the washing pump 21 is driven, the washing water stored in the sump 20 is pumped out. The pumped washing water is sprayed through the lower and upper nozzles 41 and 43 simultaneously or alternately.

In the pre-washing process, food residues adhered to the dishes are swelled. Thus, the detergent may not be fed. When the pre-washing process is finished, a drain process is performed.

When the drain process is finished, a main washing process is performed (S3). At this point, clean washing water is fed to the sump 20. In addition, the heating unit 160 is operated during or after the supply of the clean washing water to heat the washing water up to a predetermined temperature. Further, the detergent may be fed while the washing water is heated. The fed detergent is uniformly mixed with the washing water. The washing water mixed with the detergent is sprayed toward the dish racks 51 and 52. At this point, the food residues removed from the dishes fall down to the bottom of the tub 11 and filtered off by a filter.

This main washing process may be performed many times.

The used washing water is drained after the main washing process is finished. After the main washing process is finished, a rinsing process is performed. The rinsing process may include a normal temperature rinsing process (S4) and a high temperature rinsing process (S5). At this point, the normal and high temperature rinsing processes may be sequentially performed. Alternatively, only the high temperature rinsing process may be performed. This rinsing process will be described in more detail later.

When the high temperature rinsing process is finished, the used washing water is drained and a drying process is performed (S6). The drying process may be a condensing type drying process or an exhaust type drying process. In the condensing type drying process, humid air circulated by allowing cooling water to flow along a duet during a condensing process is condensed. In the condensing type drying process, since the hot and humid air in the tub 11 is not discharged to the indoor space, the indoor air is not humidified and thus it does not cause the dissatisfaction of the consumers. In the case of the exhaust type drying process, humid air in the tub 11 is discharged to the indoor space. The exhaust type drying process has an advantage of quickly drying the dishes.

After the above-described washing process is finished, the power of the dishwasher is turned off (S7).

Figure 5:
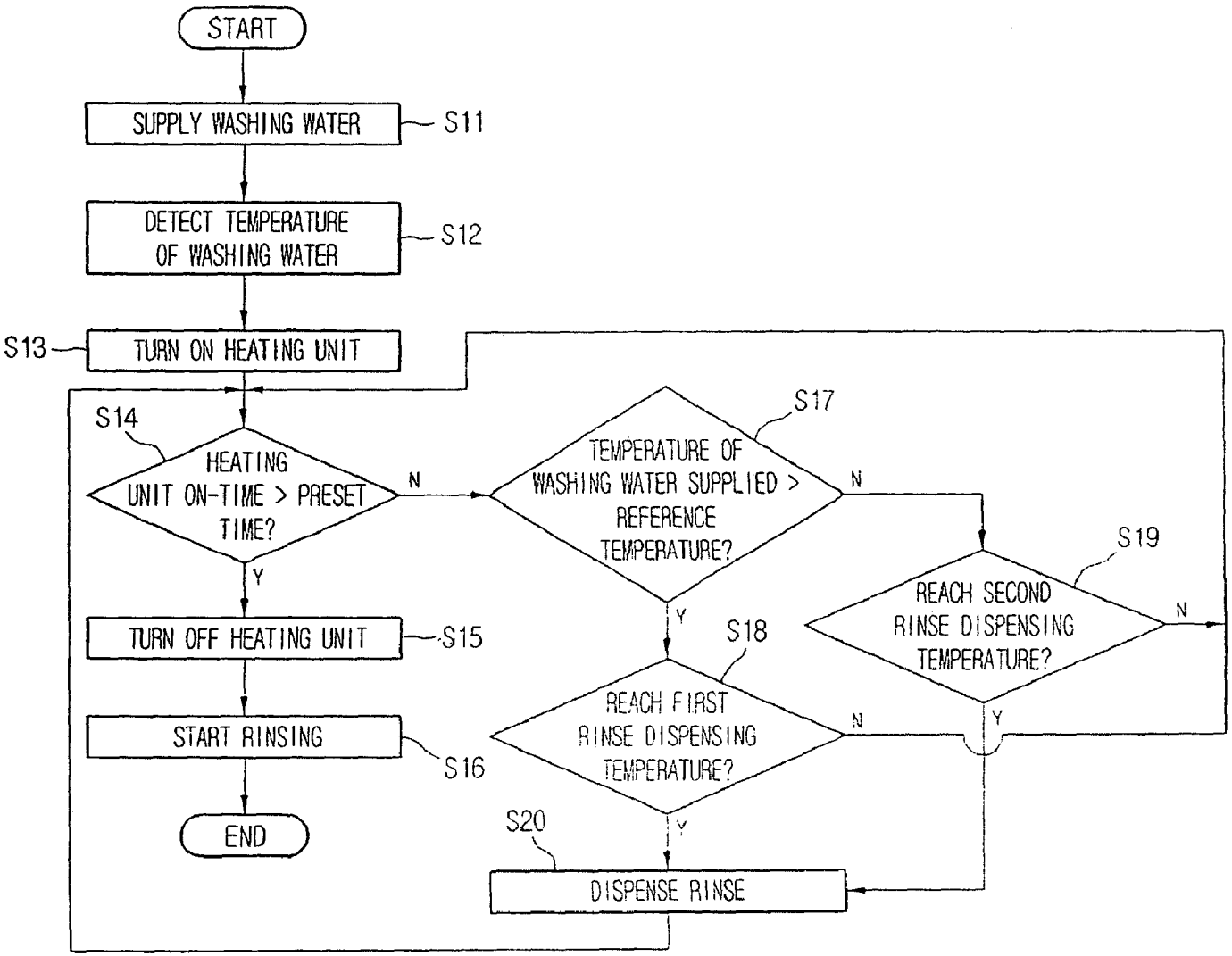
FIG. 5 is a flowchart illustrating a method of controlling the dishwasher of FIG. 1 according to an embodiment of the present invention.

FIG. 5 is a flowchart illustrating a method of controlling the dishwasher of FIG. 1 according to an embodiment of the present invention.

Referring to FIG. 5, when the high temperature rinsing process starts, the washing water is fed into the tub (S11). At this point, the temperature detecting unit detects the temperature of the washing water supplied (S12). The information on the detected temperature is sent to the control unit.

Electric power may be applied to the heating unit during or after the supply of the washing water (S13). The heating unit heats the washing water.

It is determined if the operation time of the heating unit reaches a predetermined time (S14).

When it is determined that the operation time of the heating unit does not reach the predetermined time, the control unit compares the temperature of the washing water supplied with a preset reference temperature (S17).

When it is determined that the temperature of the washing water supplied is greater than the preset reference temperature, it is determined if the temperature of the washing water that is being heated reaches a first rinse dispensing temperature (S18). When the washing water that is being heated reaches the first rinse dispensing temperature, the control unit controls the rinse dispensing unit such that the rinse can be dispensed to the tub or the sump (S20).

When it is determined that the temperature of the washing water supplied is less than or equal to the preset reference temperature, it is determined if the temperature of the washing water that is being heated reaches a second rinse dispensing temperature (S19). When it is determined that the temperature of the washing water that is being heated reaches the second rinse dispensing temperature, the control unit controls the rinse dispensing unit such that the rinse can be dispensed to the tub or the sump (S20).

Here, the first and second rinse dispensing temperature can be defined by the following equations:

First Rinse Dispensing Temperature=Heating Rinsing Cycle Temperature−"*a*" [Equation 1];

and

Second Rinse Dispensing Temperature=Heating Rinsing Cycle Temperature−"*b*" [Equation 2], where "a" is less than "b".

Referring to the equations, the first rinse dispensing temperature means a temperature that is set to be lower than the heating rinsing cycle temperature by "a" when the temperature of the washing water supplied is higher than the preset reference temperature. The second rinse dispensing temperature means a temperature that is set to be lower than the healing rinsing cycle temperature by "b" when the temperature of the washing water supplied is less than the preset reference temperature.

For example, when it is assumed that the heating rinsing cycle temperature is 70.degree. C., the temperature of the washing water supplied is 10.degree. C., the preset reference temperature 20.degree. C., the "a" is 15, and the "b" is 30,since the temperature (10.degree. C.) of the washing water supplied is less than the preset reference temperature (20.degree. C.), the rinse dispensing temperature is set as 40.degree. C. that is a temperature obtained by subtracting "b(30)" from the heating rinsing cycle temperature (70.degree. C.). Therefore, the rinse is dispensed when the washing water is heated by the heat unit up to 40.degree. C.

In addition, when it is assumed that the heating rinsing cycle temperature is 70.degree. C., the temperature of the washing water supplied is 40.degree. C., the preset reference temperature 20.degree. C., the "a" is 15, and the "b" is 30, since the temperature (40.degree. C.) of the washing water supplied is greater than the preset reference temperature (20.degree. C.), the rinse dispensing temperature is set as 55.degree. C. that is a temperature obtained by subtracting "a(15)" from the heating rinsing cycle temperature (70.degree. C.). Therefore, the rinse is dispensed when the washing water is heated by the heat unit up to 55.degree. C.

In addition, as the temperature of the washing water supplied is lowered, the rinse dispensing temperature is lowered.

As described above, the rinse dispensing temperature may vary in accordance with the temperature of the washing water supplied. When the temperature of the washing water supplied is relatively high, the rinse may be dispensed at a relatively high rinse dispensing temperature in order to enhance the activation of the rinse. When the temperature of the washing water supplied is relatively low, the rinse may be dispensed at a relatively low rinse dispensing temperature in order to improve the rinse dispensing reliability. As a result, the lines dispensing reliability can be ensured regardless of the temperature of the washing water supplied. In addition, when the temperature of the washing water supplied is too low. the rinse dispensing temperature may be too low. In this case, the rinsing cycle may be performed after the rinse is sufficiently dissolved in the washing water. Furthermore, since the time required for sufficiently dissolving the rinse in the washing water is sufficiently obtained, a case where the rinsing cycle is finished in a state where the rinse is still adhered to the surfaces of the dishes can be prevented.

Accordingly, even when a course washing process where a series of cycles of the dishwasher are performed consecutively is performed, the concept of this embodiment can be applied. Further, since the rinse dispensing timing can be adjusted in accordance with a temperature of the rinsing water under an identical heating rinsing cycle, the rinse dispensing reliability can be ensured.

Next, when the on-time of the heating unit reaches a predetermined time, the heating unit is turned off (S15) and the driving unit 34 is controlled such that the heating rinsing cycle starts (S16).

In the above-described embodiment, a case where the temperature of the washing water supplied in the heating rinsing cycle is compared with the preset reference temperature is exampled by way of example.

However, the present invention is not limited to this case. The rinsing dispensing temperature may be varied by adding a predetermined temperature value to the detected washing water temperature. For example, the rinse dispensing temperature may be varied by adding 10.degree. C. or 20.degree. C. to the temperature of the washing water supplied. At this point, a weight may be applied to the measured rinse dispensing temperature in accordance with a difference between the measured rinse dispensing temperature and a reference rinse dispensing temperature.

In addition, the rinsing cycle time may be varied in accordance with the temperature of the washing water supplied. For example, when the temperature of the washing water supplied is low, the washing water is sprayed after the washing water is heated up to the heating rinsing cycle temperature, thereby reducing the actual rinsing time by the increase of the washing water heating time. In this case, the rinsing cycle time can be extended. On the contrary, when the temperature of the washing water supplied is high, the rinsing cycle time can be shortened.

The above-described embodiments have the following advantages.

Since the rinse dispensing temperature varies in accordance with the temperature of the washing water supplied, a time required for fully dissolving the rinse in the washing water can be obtained regardless of the temperature of the washing water supplied.

Since the washing water is sprayed to the dishes after the rinse is fully dissolved in the washing water, the deterioration of the rinsing performance according to the temperature of the washing water supplied can be prevented. In addition, the case where the rinsing cycle is finished in a state where the rise is adhered to the dishes can be prevented. Furthermore, the stain of the dishes by the rinse can be prevented.

Since the rinse dispensing temperature is lowered when the temperature of the washing water is too low, a case where the rinsing cycle is performed without being dispensed with the rinse can be fundamentally prevented.

Furthermore, since the opening/closing of the detergent and rinse dispensing unit is controlled by a single valve, the manufacturing cost of the dishwasher can be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method of controlling a dishwasher, the method comprising:

measuring a temperature of washing water supplied;

heating the washing water;

determining whether the temperature of the washing water supplied has reached a preset wash water reference temperature;

choosing one of a plurality of rinse dispensing temperatures based on whether the temperature of the washing water supplied has reached the preset reference temperature or not; and dispensing rinse to the washing water when the temperature of the washing water reaches the chosen rinse dispensing temperature.

2. The method according to claim 1, wherein when it is determined that the temperature of the washing water is greater than the preset wash water reference temperature, determining if the temperature of the washing water that is being heated reaches a first rinse dispensing temperature.

3. The method according to claim 2, wherein when it is determined that the temperature of the washing water supplied is less than or equal to the preset wash water reference temperature, determining if the temperature of the washing water that is being heated reaches a second rinse dispensing temperature, wherein the first and second rinse dispensing temperatures are smaller than a heating rinsing cycle temperature, and the second rinse dispensing temperature is smaller than the first rinse dispensing temperature.

* * * * *